US008759695B2

(12) United States Patent
Pope

(10) Patent No.: US 8,759,695 B2
(45) Date of Patent: Jun. 24, 2014

(54) COMPACT THREE-HOLE LUG

(75) Inventor: Thomas Pope, North Liberty, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 294 days.

(21) Appl. No.: 13/415,638

(22) Filed: Mar. 8, 2012

(65) Prior Publication Data

US 2013/0233690 A1 Sep. 12, 2013

(51) Int. Cl.
*H01R 33/955* (2006.01)
*H01R 4/36* (2006.01)

(52) U.S. Cl.
USPC ..... 200/51.14; 200/51 R; 439/810; 439/814

(58) Field of Classification Search
USPC ..... 200/50.21–50.25, 51.14, 51 R
See application file for complete search history.

(56) References Cited

U.S. PATENT DOCUMENTS

| | | | | |
|---|---|---|---|---|
| 3,748,420 | A | 7/1973 | Rexroad | 200/168 R |
| 4,063,376 | A | 12/1977 | Horiuchi | 38/41 |
| 4,809,132 | A | 2/1989 | Palmieri et al. | 361/353 |
| 5,683,393 | A | 11/1997 | Ralph | 606/61 |
| 5,776,135 | A | 7/1998 | Errico et al. | 606/61 |
| 6,238,254 | B1 | 5/2001 | De Pourquoy et al. | 439/813 |
| 7,075,021 | B2 | 7/2006 | Rowe et al. | 200/50.21 |
| 7,445,527 | B1 * | 11/2008 | Carr | 439/814 |
| 8,303,350 | B2 * | 11/2012 | Skowranek | 439/727 |

FOREIGN PATENT DOCUMENTS

| | | | |
|---|---|---|---|
| FR | 2 946 711 A1 | 6/2009 | F16B 29/00 |

OTHER PUBLICATIONS

Square D, Mechanical Lug Kit Information Sheet, 2004 (1 page).
Schneider Electric, PowerPact® M-, P- and R-Frame, and Compact® NS630B-NS3200 Circuit Breakers Catalog, Aug. 2009 (2 pages).
PCT International Search Report for International Application No. PCT/US2013/026274, dated May 22, 2013 (6 pages).
PCT Written Opinion for International Application No. PCT/US2013/026274, dated May 22, 2013 (6 pages).

* cited by examiner

*Primary Examiner* — Renee S Luebke
*Assistant Examiner* — Ahmed Saeed
(74) *Attorney, Agent, or Firm* — Locke Lord LLP

(57) ABSTRACT

A circuit breaker assembly includes a lug assembly with a main structural body having cable holes extending through a cable-receiving face, the cable holes including a first cable hole separated by a second cable hole from a third cable hole. Each of the cable holes is configured to receive a respective power cable. The structural body further includes wire-binding holes extending at least in part through a wire-binding face, the wire-binding holes including a first wire-binding hole separated by a second wire-binding hole from a third wire-binding hole. The first wire-binding hole has a first longitudinal axis at an angle that intersects a third longitudinal axis of the third wire-binding hole. A fastener is inserted through the second wire-binding hole, the fastener having an hourglass section with a contour that generally matches at least in part a corresponding contour of the first cable hole and the third cable hole.

17 Claims, 5 Drawing Sheets

COMPACT THREE-HOLE LUG

FIELD OF THE INVENTION

This invention is directed generally to circuit breakers, and, more particularly, to a lug assembly having angled wired-binding holes and an hourglass-shaped fastener.

BACKGROUND OF THE INVENTION

Circuit breakers are well known and commonly used to protect automatic circuit interruption to a monitored circuit when undesired conditions occurs. For example, a circuit breaker is designed to interrupt current flowing in the monitored circuit when it detects one or more of an overload condition, a ground fault condition, or a short-circuit condition.

Typically, a circuit breaker is electrically and physically connected to a power cable via a lug (or wire connector), which includes a wire-binding screw fastened to the power cable. The power cable is received in a cable hole, while the wire-binding screw is received in a wire-binding hole, the two holes being generally perpendicular and aligned with each other. In confined spaces, the lug may include multiple cable holes, each one having a corresponding wire-binding hole (and wire-binding screw). Space, whether equipment space, or dielectric clearance space, is always at a premium for enclosed electrical distribution equipment.

SUMMARY OF THE INVENTION

In an implementation of the present invention, a compact three-hole lug is mounted to a circuit breaker for attachment of power cables in a small space. The lug includes three primary holes for receiving, respectively, the power cables. The three primary holes include two upper holes and a bottom hole. The two upper holes are located on a front surface, near a top surface, of the lug. The bottom hole is located on the front surface between and below the two upper holes, near a bottom surface of the lug.

The lug further includes three secondary holes for receiving respective fasteners, which clamp in position the power cables. The secondary holes are located on the top surface and include a first secondary hole, a second secondary hole, and a third secondary hole. The first secondary hole is aligned with, and extends through the lug to, a first upper hole. The second secondary hole is aligned with, and extends through the lug to, the bottom hole. The third secondary hole is aligned with, and extends through the lug to, a second upper hole.

The first secondary hole and the third secondary hole are symmetrically positioned relative to the second secondary hole. The first secondary hole is angled such that its longitudinal axis is angled toward a longitudinal axis of the second secondary hole. Similarly, the third secondary hole is angled such that its longitudinal axis is angled toward the longitudinal axis of the second secondary hole (and the longitudinal axis of the first secondary hole). The angled orientation of the longitudinal axes helps reduce the size of the lug by allowing the placement of the two upper holes closer to a central location of the front surface, as opposed to closer to an outside edge of the front surface.

Each of the two upper primary holes receives a fastener, e.g., a wire-binding screw, extending through the secondary holes for clamping a respective power cable in position relative to the lug. The bottom hole receives an hourglass-shaped screw for clamping the respective power cable in position relative to the lug. The hourglass-shaped screw is generally longer than the wire-binding screws received in the two upper holes and has a middle section of reduced material, which allows the power cables received in the two upper holes to clear without interference.

In another implementation of the present invention, a circuit breaker assembly includes a circuit breaker and a mechanical lug assembly for attachment of power cables. The mechanical lug assembly is mounted to the circuit breaker and includes a main structural body having a cable-receiving face and a wire-binding face. The cable-receiving face is generally defined by a height and a width of the body, the wire-binding face being generally perpendicular to the cable-receiving face and defined by the width and a thickness of the body (noting that the wire-binding face may have angled facets/planes). A plurality of cable holes extend through the cable-receiving face, the cable holes including a first cable hole separated by a second cable hole from a third cable hole. Each of the cable holes is configured to receive a respective one of the power cables. A plurality of wire-binding holes extend at least in part through the wire-binding face, the wire-binding holes including a first wire-binding hole separated by a second wire-binding hole from a third wire-binding hole. The first wire-binding hole has a first longitudinal axis at an angle that intersects a third longitudinal axis of the third wire-binding hole. An hourglass-shaped fastener is received through the second wire-binding hole, the hourglass-shaped fastener having an hourglass section with a contour that generally matches at least in part a corresponding contour of the first cable hole and the third cable hole.

In another alternative implementation of the present invention, a circuit breaker assembly includes a mechanical lug assembly mounted to a circuit breaker. The mechanical lug assembly includes a body having a first side generally perpendicular to a second side, the first side having a greater surface area than the second side. The mechanical lug assembly further includes a first set of holes extending through the first side, the first set of holes including a pair of symmetrical holes, and a second set of holes extending through the second side, the second set of holes including a first hole, a second hole, and a third hole. The second hole is located between the first hole and the third hole, the first hole having a first longitudinal axis, the second hole having a second longitudinal axis, and the third hole having a third longitudinal axis. The first longitudinal axis is inclined at a first angle relative to the second longitudinal axis, the third longitudinal axis being inclined at a second angle relative to the second longitudinal axis. The first longitudinal axis intersects the third longitudinal axis at a point away from the first hole and the third hole. An hourglass-shaped fastener is received through the second hole, the hourglass-shaped fastener having an hourglass section of reduced material that is positioned near the pair of symmetrical holes.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Figure 1:
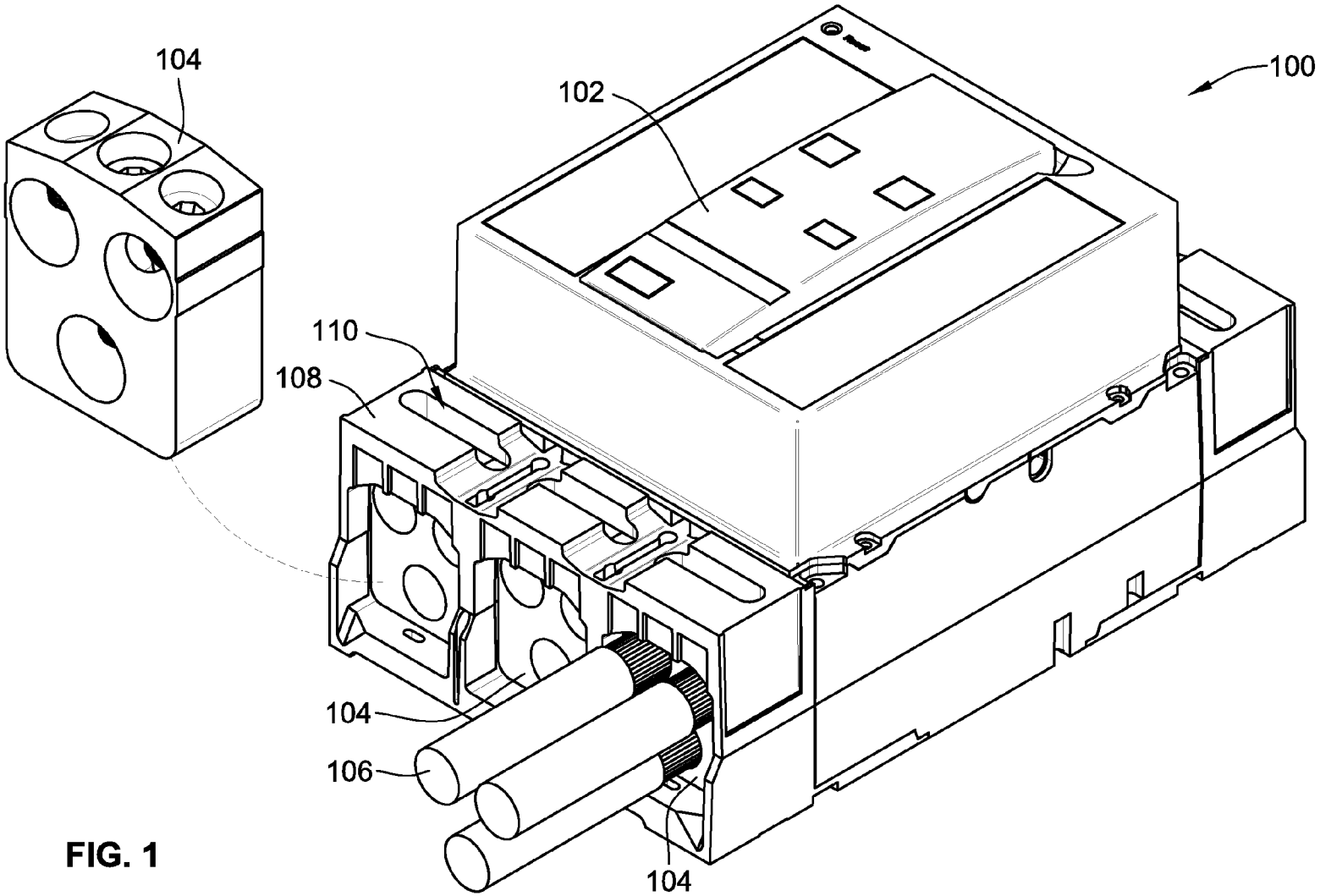
FIG. 1 is a perspective view illustrating a circuit breaker assembly.

Referring to FIG. 1, a circuit breaker assembly 100 includes a circuit breaker housing 102 for enclosing internal components of the circuit breaker assembly 100. The circuit breaker assembly 100 includes a plurality of mechanical lug assemblies 104, which are adapted for receiving power cables 106. Alternatively, the power cables 106 can be any wires, terminals, conductors, etc.

Each mechanical lug assembly 104 is securely mounted in a respective receiving enclosure 108 of the circuit breaker housing 102. Each of the enclosures 108 has a top aperture 110 for facilitating adjustment of fasteners used to clamp the power cables 106 securely in position. For example, a screwdriver or an allen wrench can be inserted through the top apertures 110 to tighten a loose fastener of the mechanical lug assemblies 104 that clamps a respective one of the power cables 106.

Figure 2:
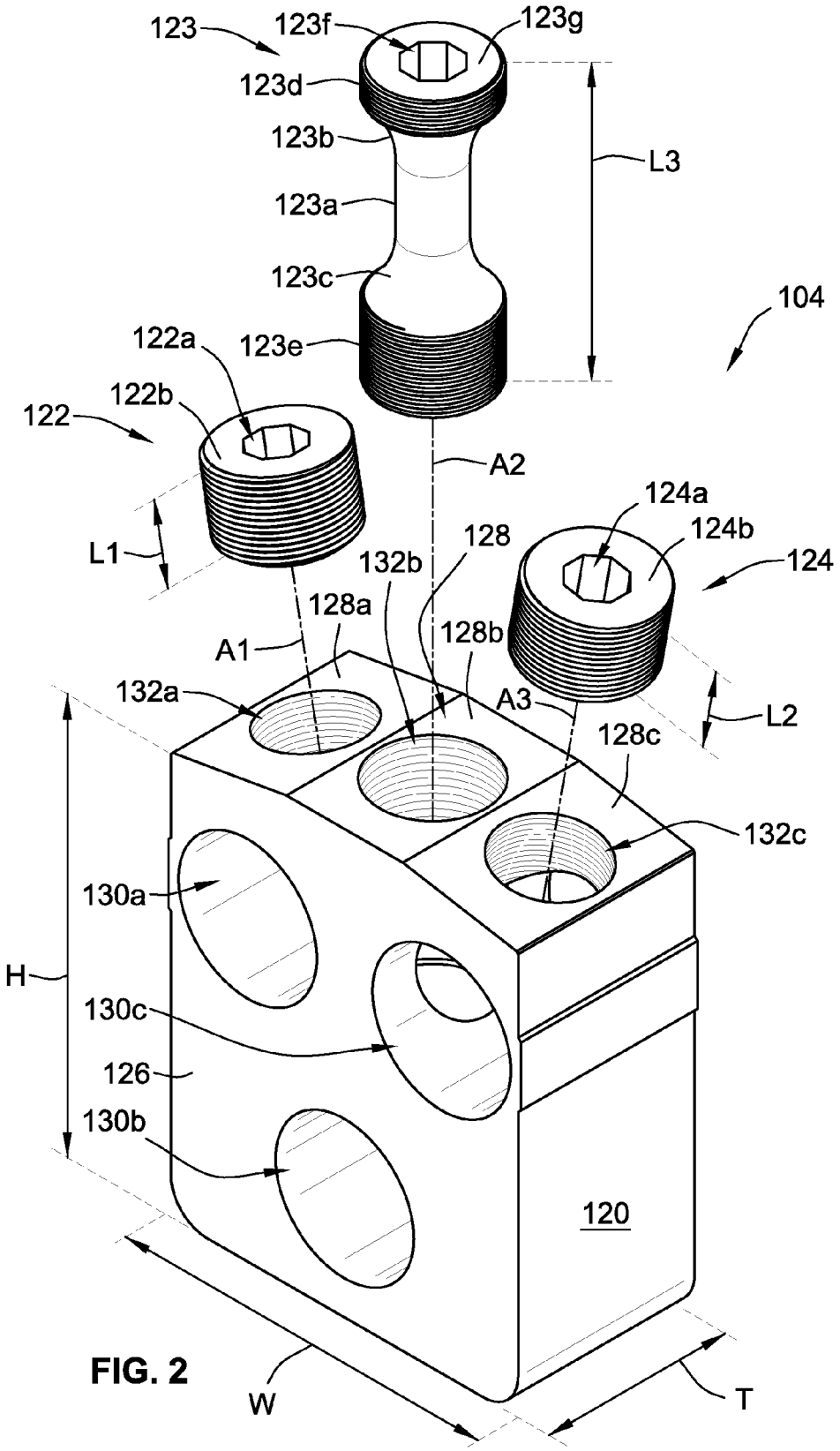
FIG. 2 is an exploded view illustrating a mechanical lug assembly.

Referring to FIG. 2, the mechanical lug assembly 104 includes a main structural body 120 and a plurality of fasteners 122-124. The main structural body 120 has a cable-receiving face 126 defined generally by a height H and a width W of the main structural body 120. The main structural body 120 further has a wire-binding face 128 defined generally by the width W and a thickness T of the main structural body 120. The wire-binding face 128 is generally perpendicular to the cable-receiving face 126.

On the cable-receiving face 126, the main structural body 120 has three cable holes 130*a*-130*c* that extend completely through the thickness T. The three cable holes 130*a*-130*c* include a first cable hole 130*a* that is separated by a second cable hole 130*b* from a third cable hole 130*c*. Each of the cable holes 130*a*-130*c* is configured to receive a respective power cable 106 (shown in FIG. 1). According to the illustrated embodiment, the cable holes 130*a*-130*c* have generally the same diameter.

On the wire-binding face 128, the main structural body 120 has three wire-binding holes 132*a*-132*c* that extend in part through the height H (as shown and described in more detail in reference to FIG. 3) of the main structural body 120. The wire-binding holes 132*a*-132*c* include a first wire-binding hole 132*a* that is separated by a second wire-binding hole 132*b* from a third wire-binding hole 132*c*. According to the illustrated embodiment, the wire-binding holes 132*a*-132*c* have generally the same diameter.

The wire-binding face 128 has three sections 128*a*-128*c*, each of the sections corresponding to one of the wire-binding holes 132*a*-132*c*. The three sections include a first section 128*a* that is generally angled relative to a generally horizontal plane, a second section 128*b* that is generally parallel to the horizontal plane, and a third section 128*c* that is generally angled relative to the horizontal plane. In the example of FIG. 2, the first section 128*a* and the third section 128*c* are symmetrically angled relative to the second section 128*b*.

One of the fasteners 122-124 is an hourglass-shaped fastener 123 that has an hourglass section 123*a* having an upper section 123*b* and a lower section 123*c*. The hourglass-shaped fastener 123 further has a top threaded section 123*d* and a bottom threaded section 123*e*. Optionally, only one of the sections 123*d*, 123*e* is threaded (e.g., only the top section 123*d*). A tool-receiving hole 123*f* is located internally in the top threaded section 123*d* and extends longitudinally from a top surface 123*g*.

The other two fasteners include a first set screw 122 and a second set screw 124, each with a respective tool-receiving hole 122*a*, 124*a* extending longitudinally from a corresponding top surface 122*b*, 124*b*. In this example, the set screws 122, 124 are generally identical to each other and have a length L1, L2 that is shorter than a length L3 of the hourglass-shaped fastener 123. In other examples, the set screws 122, 124 can be other types of fasteners, including bolts and other types of wire-binding screws.

Figure 3:
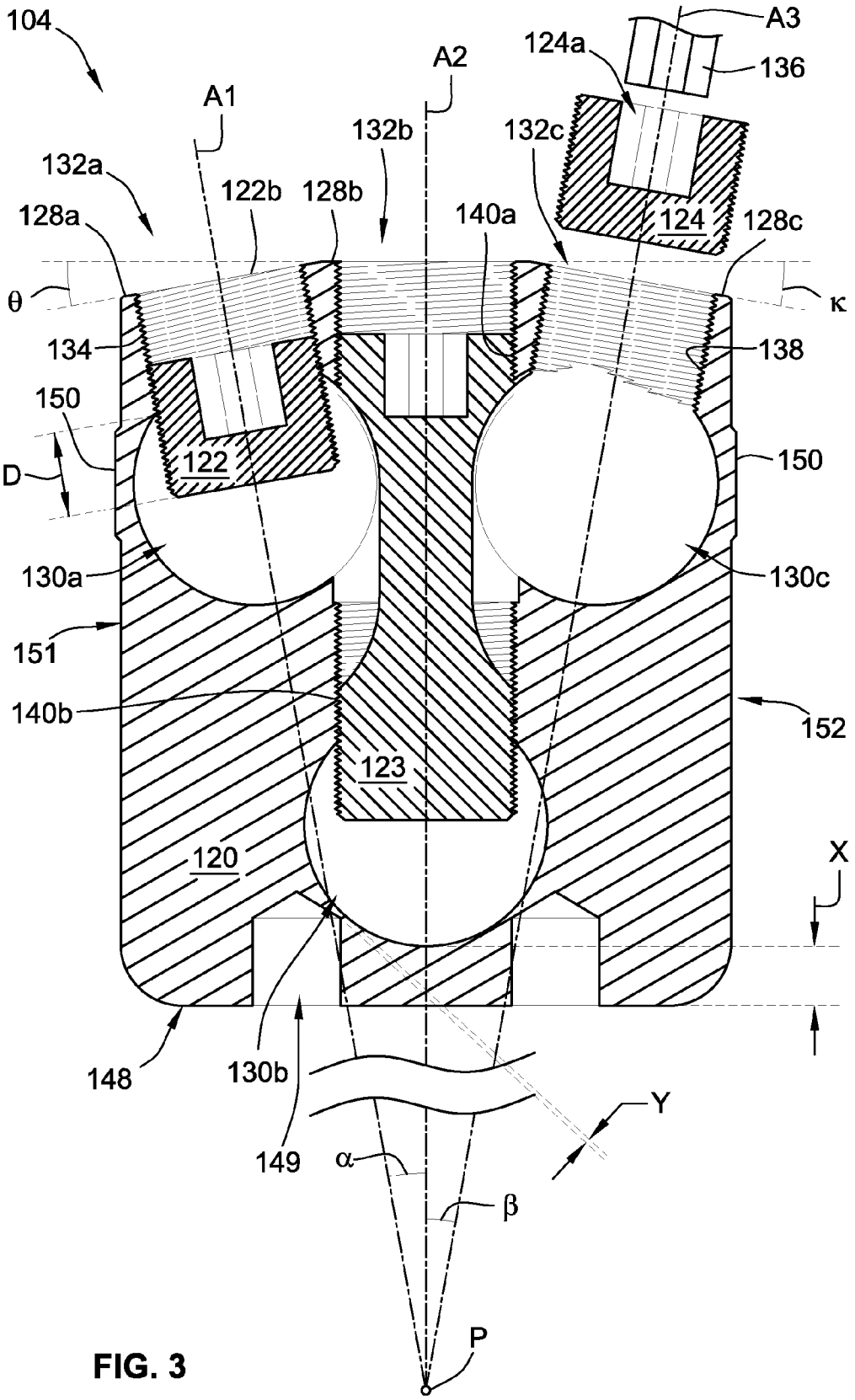
FIG. 3 is a cross-sectional view illustrating the mechanical lug assembly.

Referring to FIG. 3, the mechanical lug assembly 104 is illustrated with the first set screw 122 and the hourglass-shaped fastener 123 mounted in their respective wire-binding holes 132*a*, 132*b*. The first set screw 122 is threadedly engaged within the first wire-binding hole 132*a* via a set of internal threads 134 of the first wire-binding hole 128. The first set screw 122 protrudes a sufficient distance D within the first cable hole 130*a* to secure in place, when received, a power cable 106.

The first wire-binding hole 132*a* extends partially through the height H of the main structural body 120, from the first section 128*a* of the wire-binding face 128 to the first cable hole 130*a*. The second wire-binding hole 132*b* extends partially through the height H, from the second section 128*b* to the second cable hole 130*b*. The third wire-binding hole 132*c* extends partially through the height H, from the third section 128*c* to the third cable hole 130*c*.

The first wire-binding hole 132*a* has a first longitudinal axis A1 that is angled at an angle $\alpha$ relative to a second longitudinal axis A2 of the second wire-binding hole 132*b*. The first longitudinal axis A1 is angled and oriented to intersect, at a point P, a third longitudinal axis A3 of the third wire-binding hole 132*c*. The third longitudinal axis A3 of the third wire-binding hole 132*c* is angled at an angle $\beta$ relative to the second longitudinal axis A2 of the second wire-binding hole 132*b*. In the example of FIG. 3, angles $\alpha$ and $\beta$ are symmetrically identical.

In FIG. 3, the top surface 122*b* of the first set screw 122 is generally flush with the first section 128*a* of the wire-binding face 128. The first section 128*a* is inclined at an angle $\theta$ relative to the second section 128*b* of the wire-binding face 128. Similarly, the third section 128*c* is inclined at an angle $\kappa$ relative to the second section 128*b* of the wire-binding face. In the example of FIG. 3, angles $\theta$ and $\kappa$ are symmetrically identical.

The second set screw 124 is illustrated prior to being secured in the third wire-binding hole 132*c*. An allen wrench 136 is inserted into the tool-receiving hole 124*a* to fasten the second set screw 124 into the third wire-binding hole 132*c*, which includes a set of internal threads 138 for matching the threads of the second set screw 124.

The hourglass-shaped fastener 123 is threadedly engaged within the second wire-binding hole 132*b* via a set of top and bottom internal threads 140*a*, 140*b* of the second wire-binding hole 132*b*. When the hourglass-shaped fastener 132 is positioned in the second wire-binding hole 132*b*, with the top surface 123*g* being positioned generally flush with the second section 128*b* of the wire-binding face 128, the hourglass section 123*a* matches the contour of the first cable hole 130*a* and the contour of the third cable hole 130*c*. Given that the upper section 123*b* of the hourglass section 123*a*, is generally narrower than the top threaded section 123*d*, this position allows the hourglass-shaped fastener 123 to clear entirely the first cable hole 130*a* and the third cable hole 130*c*. In turn, the clearance facilitated by the matching contours of the upper section 123*b* and the adjacent cable holes 130*a*, 130*c* provides unobstructed insertion of power cables 106 into the respective cable holes 130*a*, 130*c*.

The hourglass-shaped fastener 123 is optionally asymmetrical along its longitudinal axis, having the upper section 123*b* generally longitudinally smaller than the lower section 123*c*. One advantage of having an asymmetrical shape is to have the first cable hole 130*a* and the third cable hole 130*c* unencumbered throughout a range of positions of the hourglass-shaped fastener 123, as the hourglass-shaped fastener 123 is threaded/unthreaded into the second wire-binding hole 132*b*.

The second cable hole 130*b* is positioned as low as possible from a bottom face 148, at a minimum distance X, to facilitate insertion of as many threads as possible for the hourglass-shaped fastener 123 into the second wire-binding hole 132*b*. The minimum distance X is dependent on a minimum clearance Y between the periphery of the second cable hole 130*b* and an internal edge of a mounting hole 149.

The mechanical lug assembly 104 includes a pair of protrusions 150 extending outwards from left and right faces 151, 152. The protrusions 150 are added for increased strength near the outer periphery of the first and third cable holes 130*a*, 130*c*.

Figure 5:
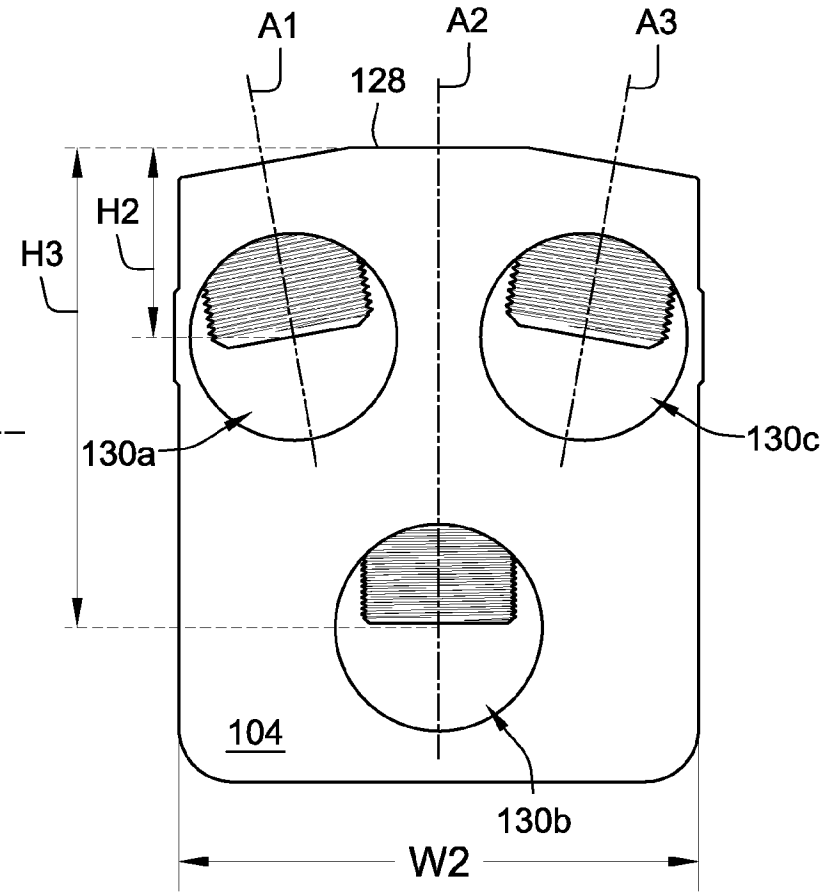
FIG. 5 is a side view of a narrow mechanical lug assembly.
Figure 4:
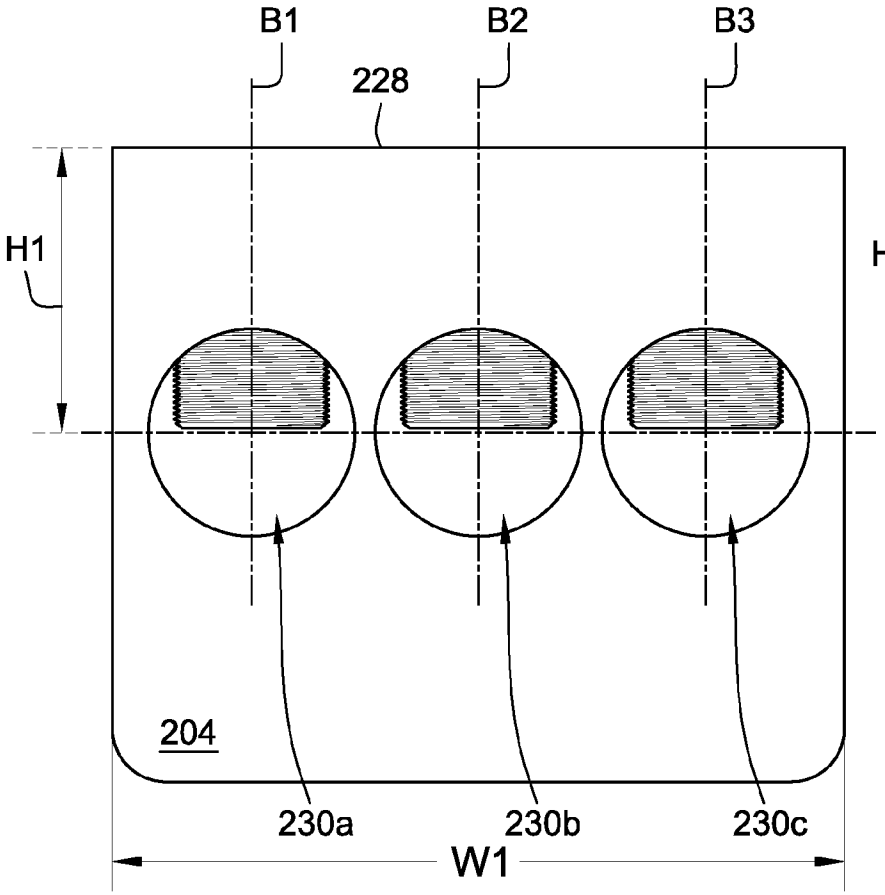
FIG. 4 is a side view of a wide mechanical lug assembly.

In reference to FIGS. 4 and 5, the configuration of the mechanical lug assembly 104 facilitates attachment of power cables in a smaller available space than otherwise possible. For example, FIG. 4 illustrates a configuration in which a wide mechanical lug assembly 204, such as might be known in the art, has three cable holes 230*a*-230*c* that are positioned alongside each other at the same height H1 from a topmost section of a wire-binding face 228. Furthermore, each longitudinal axis B1-B3 of wire-binding holes corresponding to the cable holes 230*a*-230*c* is generally parallel to each other, in a generally vertical direction. As a result, the wide mechanical lug assembly 204 has a width W1 that is greater than a width W2 of the mechanical lug assembly 104 described above in reference to FIGS. 1-3.

Specifically, in reference to FIG. 5 (and as discussed above in reference to FIGS. 1-3), the mechanical lug assembly 104 of the present invention has the three cable holes 130*a*-130*c* positioned such that the first cable hole 130*a* and the third cable hole 130*c* are at the same height H2 from the wire-binding face 128, and the second cable hole 130*b* is at a height H3 from the topmost section of the wire-binding face 128. As a result, the mechanical lug assembly 104 of the present invention is narrower than other configurations (such as the exemplary configuration of the mechanical lug assembly 204), and, accordingly, can facilitate clamping power cables 106 in smaller spaces. The narrower configuration is a result of one or more of the following features: (a) the positioning of the cable holes 130*a*-130*c* relative to the wire-binding face 128; (b) the angled orientation of the longitudinal axes A1 and A3 of the first and third wire-binding holes 132*a*, 132*c* relative to the longitudinal axis A2 of the second wire-binding hole 132*b*; and (c) the area of reduced material in the hourglass section 123*a* to eliminate or reduce potential interference between the hourglass-shaped fastener 123 and power cables 106 received respectively in the first cable hole 130*a* and the third cable hole 130*c* (i.e., to allow power cables 106 to clear the respective cable holes 130*a*, 130*c*).

Figure 7:
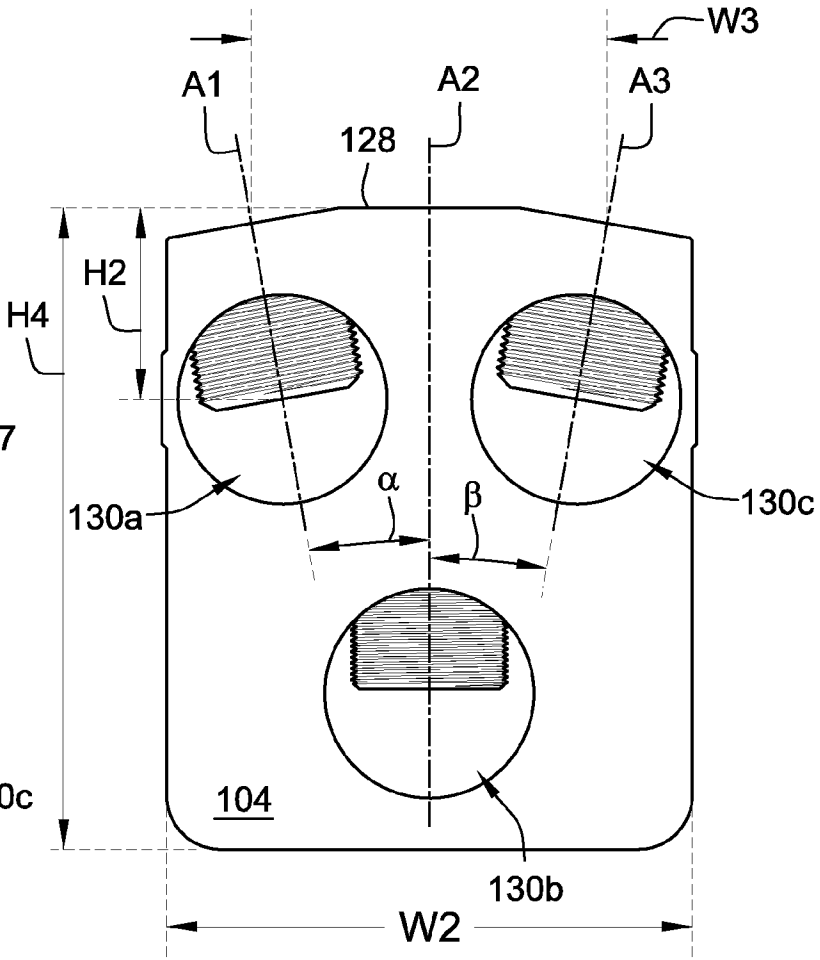
FIG. 7 is a side view of a short mechanical lug assembly.
Figure 6:
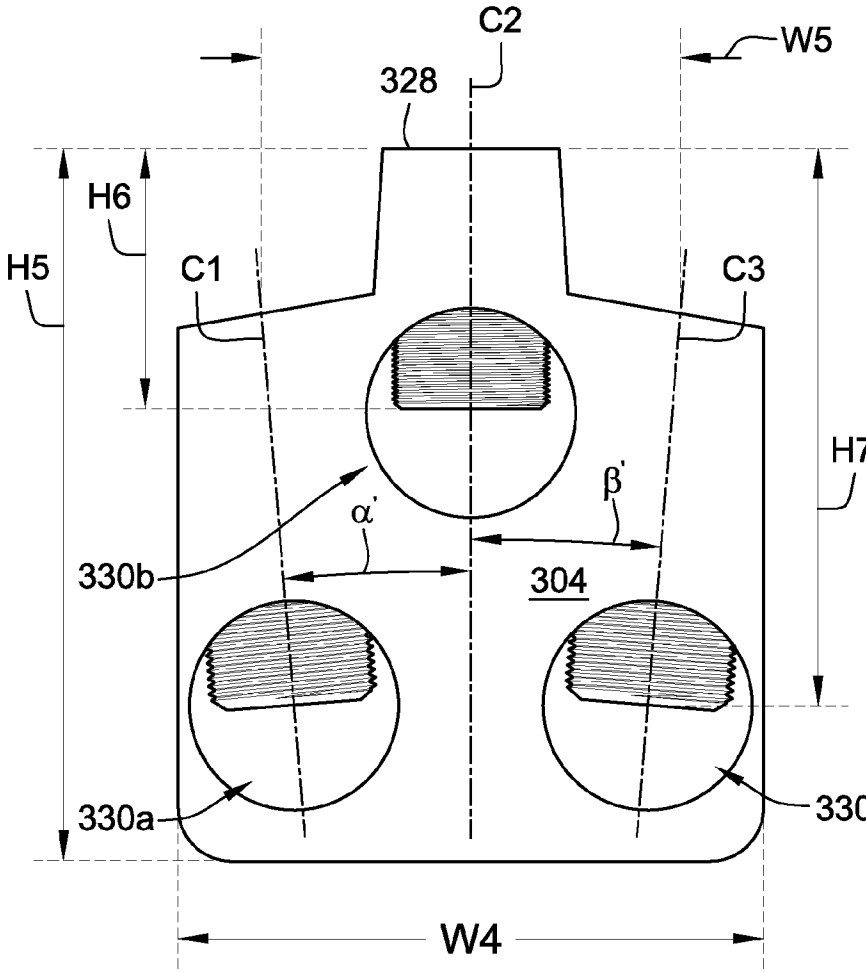
FIG. 6 is a side view of a tall mechanical lug assembly.

In reference to FIGS. 6 and 7, a further example illustrates that the configuration of the mechanical lug assembly 104 facilitates attachment of power cables in a smaller available space than otherwise possible. For example, FIG. 6 illustrates a configuration in which a tall mechanical lug assembly 304, such as known in the art, has three cable holes 330*a*-330*c* that are positioned alongside at different heights H6, H7 from a topmost section of a wire-binding face 328. The three cable holes 330*a*-330*c* are positioned with a first cable hole 330*a* positioned lower than a second cable hole 330*b*, relative to the topmost section of the wire-binding face 328, at the same height H7 as a third cable hole 330*a*.

Relative to the tall mechanical lug assembly 304, the mechanical lug assembly 104 of the present invention has both a smaller width (i.e., W2<W4) and a smaller height (i.e., H4<H5). The smaller size of the mechanical lug assembly 104 of the present invention is a result, in part, of the specific configuration of the cable holes 130*a*-130*c* having the first cable hole 130*a* and the third cable hole 130*c* at a height H2 that is as small as possible to decrease angles $\alpha$ and $\beta$ as much as possible. For example, the lower position of the first cable hole 330*a* and third cable hole 330*c* of the tall mechanical lug assembly 304 (i.e., H7>H2) results in a wider separation width W5 between the two cable holes 330*a*, 330*c* (i.e., W5>W3) because the angles of longitudinal axes C1, C3 (of the corresponding wire-binding holes of the first and third cable holes 330*a*, 330*c*) with respect to the horizontal longitudinal axis C3 (of the corresponding wire-binding hole of the second cable hole 330*b*) is increased relative to the angles of longitudinal axes A1, A3 (e.g., angle $\alpha'$>angle $\alpha$; angle $\beta'$>angle $\beta$).

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A circuit breaker assembly comprising:

a circuit breaker; and a mechanical lug assembly for attachment of power cables, the mechanical lug assembly mounted to the circuit breaker and including a main structural body having a cable-receiving face and a wire-binding face, the cable-receiving face being generally defined by a height and a width of the body, the wire-binding face being generally perpendicular to the cable-receiving face and defined by the width and a thickness of the body, a plurality of cable holes extending through the cable-receiving face, the cable holes including a first cable hole separated by a second cable hole from a third cable hole, each of the cable holes being configured to receive a respective one of the power cables, a plurality of wire-binding holes extending at least in part through the wire-binding face, the wire-binding holes including a first wire-binding hole separated by a second wire-binding hole from a third wire-binding hole, the first wire-binding hole having a first longitudinal axis at an angle that intersects a third longitudinal axis of the third wire-binding hole, and an hourglass-shaped fastener received through the second wire-binding hole along a second longitudinal axis, the hourglass-shaped fastener having an hourglass section with a contour that maximizes a corresponding contour of the first cable hole and the third cable hole.

2. The circuit breaker assembly of claim 1, wherein the hourglass-shaped fastener includes a top threaded section separated by the hourglass section from a bottom threaded section.

3. The circuit breaker assembly of claim 2, wherein the second wire-binding hole has threaded sections for receiving, correspondingly, the top threaded section and the bottom threaded section of the hourglass-shaped fastener.

4. The circuit breaker assembly of claim 1, wherein the hourglass section is asymmetrical along a longitudinal axis of the hourglass-shaped fastener.

5. The circuit breaker assembly of claim 1, wherein the second wire-binding hole is centrally located along the width of the body and is aligned with the second cable hole, the second wire-binding hole extending to the second cable hole.

6. The circuit breaker of assembly claim 1, wherein the first cable hole and the third cable hole are aligned to each other at the same distance away from the wire-binding face, the second cable hole being located at a greater distance away from the wire-binding face than the first cable hole and the third cable hole.

7. The circuit breaker assembly of claim 1, further comprising a first wire-binding fastener inserted in the first wire-binding hole and a second wire-binding fastener being inserted in the second wire-binding hole.

8. A circuit breaker assembly comprising:

a circuit breaker; and a mechanical lug assembly mounted to the circuit breaker and including a body having a first side generally perpendicular to a second side, the first side having a greater surface area than the second side, a first set of holes extending through the first side, the first set of holes including a pair of symmetrical holes, a second set of holes extending through the second side, the second set of holes including a first hole, a second hole, and a third hole, the second hole being located between the first hole and the third hole, the first hole having a first longitudinal axis, the second hole having a second longitudinal axis, the third hole having a third longitudinal axis, the first longitudinal axis being inclined at a first angle relative to the second longitudinal axis, the third longitudinal axis being inclined at a second angle relative to the second longitudinal axis, the first longitudinal axis intersecting the third longitudinal axis at a point away from the first hole and the third hole, and an hourglass-shaped fastener received through the second hole, the hourglass-shaped fastener having an hourglass section of reduced material that is positioned near the pair of symmetrical holes.

9. The circuit breaker assembly of claim 8, wherein the hourglass-shaped fastener includes a threaded section for engaging a threaded section of the second hole.

10. The circuit breaker assembly of claim 9, wherein the threaded section includes a top threaded section and a bottom threaded section.

11. The circuit breaker assembly of claim 10, wherein the second hole has threaded sections for receiving, correspondingly, the top threaded section and the bottom threaded section of the hourglass-shaped fastener.

12. The circuit breaker assembly of claim 8, wherein the hourglass section is asymmetrical along a longitudinal axis of the hourglass-shaped fastener.

13. The circuit breaker assembly of claim 8, wherein the second hole is centrally located along a width direction of the body and is aligned with a middle hole of the first set of holes, the second hole extending to the middle hole.

14. The circuit breaker assembly of claim 8, further comprising a pair of wire-binding fasteners inserted respectively through the pair of symmetrical holes.

15. The circuit breaker assembly of claim 8, wherein the second side includes a plurality of planes including a first plane, a second plane, and a third plane, a first one of the symmetrical holes being located on the first plane, the middle hole being located on the second plane, and a second one of the symmetrical holes being located on the third plane.

16. The circuit breaker assembly of claim 8, wherein the first plane and the third plane are symmetrically angled relative to the second plane.

17. The circuit breaker assembly of claim 8, wherein the second plane is generally horizontal relative to the first plane and the third plane, the first plane and the third plane being angled relative to the second plane.

* * * * *